United States Patent [19]

Locke

[11] Patent Number: 4,896,420

[45] Date of Patent: Jan. 30, 1990

[54] ELECTRIC SHAVER

[75] Inventor: David R. Locke, Bridgeport, Conn.

[73] Assignee: Remington Products, Inc., Bridgeport, Conn.

[21] Appl. No.: 105,876

[22] Filed: Oct. 7, 1987

[51] Int. Cl.[4] ..... B26B 19/42

[52] U.S. Cl. ..... 30/34.2; 30/41; 30/43.92; 30/45; 30/DIG. 2

[58] Field of Search ..... 30/34.2, 41, 43, 43.92, 30/43.91, 45, DIG. 2

[56] References Cited

U.S. PATENT DOCUMENTS 2,170,215 8/1939 Rand, Jr. ..... 30/34.2

2,991,554 7/1961 Somers et al. ..... 30/34.2

3,406,448 10/1968 MacCarthy ..... 30/34.2

3,945,115 3/1976 Daniels ..... 30/34.2

FOREIGN PATENT DOCUMENTS 784909 10/1957 United Kingdom ..... 30/34.2

*Primary Examiner*—Hien H. Phan

[57] ABSTRACT

An electric dry shaver is described having an improved skin stretcher for enhancing performance of the shaver. The skin stretcher includes a slide body which can be positioned for effecting the skin stretching function or retracted for enabling the shaver to be used at difficult to reach body sites.

6 Claims, 2 Drawing Sheets

ELECTRIC SHAVER

BACKGROUND OF THE INVENTION

1. Field of the Invention

This invention relates to an improved electric dry shaver. The invention relates more particulary to an improved electric dry shaver having means for enhancing the cutting performance of the shaver.

2. Description of the Prior Art

Electric dry shavers generally include a hand held housing and a cutter head, the housing being manipulated for advancing the cutter head into contact with the user's face or other body site at which hair is to be shaved. In general, the cutter head includes an outer, stationary, apertured cutter member and an inner, reciprocating cutter member which operates in shearing engagement with the outer cutter member. An electrical motor is positioned in the housing and is mechanically coupled to the cutter head for imparting reciprocating motion to the inner cutter member. The user's hairs which extend through the apertures in the outer cutter member are thereby sheared by the cutter members.

It is known that the cutting performance of an electric dry shaver can be improved by stretching or tensioning the user's skin at the site which the cutter head engages. This causes body hairs to be presented to the cutter head in a relatively erect attitude and reduces skin waves and skin undulations which the cutter head might otherwise not fully contact.

Although the desireability of tensioning the skin to achieve improved cutter head performance has been appreciated, the accomplishment of the same has not been readily achieved in connection with electric dry shavers. Prior arrangements have been relatively complex, in some cases not durable, not conveniently used and relatively unreliable. Moreover, electric dry shavers often include a hair or sideburn trimmer which is fixedly mounted at one side of the cutter head and to a certain extent limits manipulation of the shaver. Use of a trimmer requires that the advancing movement of the cutter head be effected by a side of the shaver opposite to the trimmer which does not present an auxiliary trimmer to interfere with the ready replacement of a leading surface of the shaver head. Consequently, placement of a skin tensioning means to be used in cooperation with the cutter head is limited. Placement of a skin stretcher means at a location within the width of the cutter head is usually unsatisfactory for the reason that adequate skin tensioning is not provided. Similarly, the placement of a fixed skin tensioning means at a side of the shaver opposite the trimmer interferes with and limits cutting of hair in such difficult to reach places as under the nose, in proximity to sideburns, adjacent to moustache, etc.

SUMMARY OF THE INVENTION

Accordingly, it is an object of this invention to provide an electric dry shaver having a hair trimmer mounted at one side of the cutter head and a skin stretching means mounted adjacent an opposite side of the cutter head and in which the skin stretching means avoids restricting use of the shaver at difficult to reach body locations.

Another object of the invention is to provide an electric dry shaver having a skin stretching means which provides an improved performance over prior skin tensioning arrangements.

Another object of the invention is to provide an electric dry shaver having a skin stretching means positioned adjacent a side of the cutter head and which does not interfere with use of the shaver in difficult to reach body locations.

Another object of the invention is to provide an electric dry shaver having an improved skin stretching means.

A further object of this invention is to provide an improved form of electrical dry shaver.

In accordance with the invention, an electric dry shaver comprises a hand held housing and a cutter head mounted to the housing. The cutter head includes an elongated, longitudinally extending hair cutter assembly. An elongated, longitudinally extending, skin stretcher means is laterally spaced from and extends generally parallel with the hair cutter assembly. A means is provided for enabling a user to manually and selectively advance the skin stretcher means to a first, extended position at which location the skin stretcher means engages and causes skin tensioning over a body area which includes the area of skin engagement by the cutter head assembly. Alternatively, a user can selectively withdraw the skin stretcher means to a second retracted position at which location the skin stretcher means is positioned out of engagement with the user's skin when the shaver is in use, thus inhibiting skin tensioning and enabling use of the shaver at difficult to reach body locations.

In accordance with features of a particular embodiment of the invention, the shaver head includes a hair trimmer means mounted at one side of the shaver head and a skin stretching means comprising a slide body mounted at a second opposite side of the shaver head. A means provides sliding contact between the slide body and shaver head, for positioning the skin stretching means at a first advanced location and for biasing the slide body at this location. The positioning means also provides for withdrawing the skin stretching means to a second, retracted position and for biasing the slide body at this second position.

BRIEF DESCRIPTION OF THE DRAWINGS

These and other objects and features of the invention will become apparent with reference to the following specification and to the drawings wherein.

DETAILED DESCRIPTION

Figure 1:
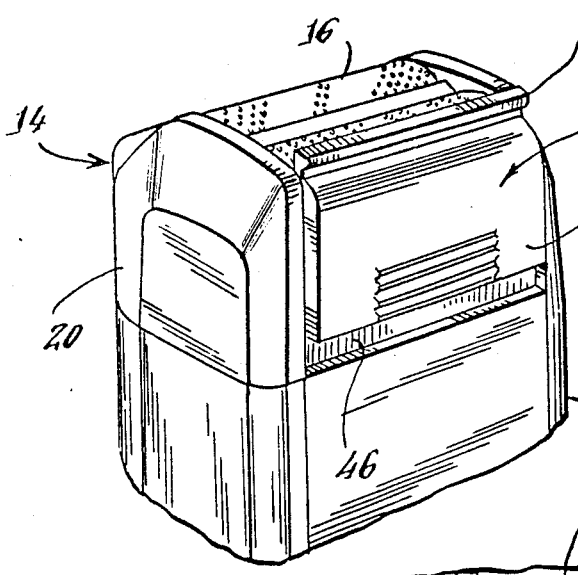
FIG. 1 is a fragmentary, perspective view of one embodiment of the electric dry shaver of this invention.
Figure 2:
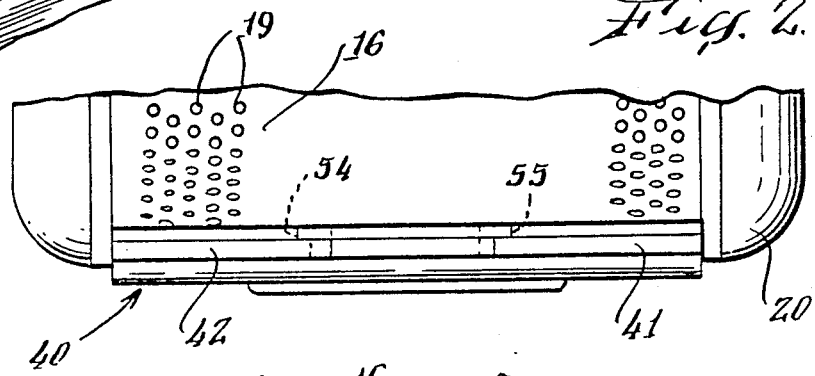
FIG. 2 is a fragmentary, top plan view of a part of the electric dry shaver of FIG. 1.
Figure 3:
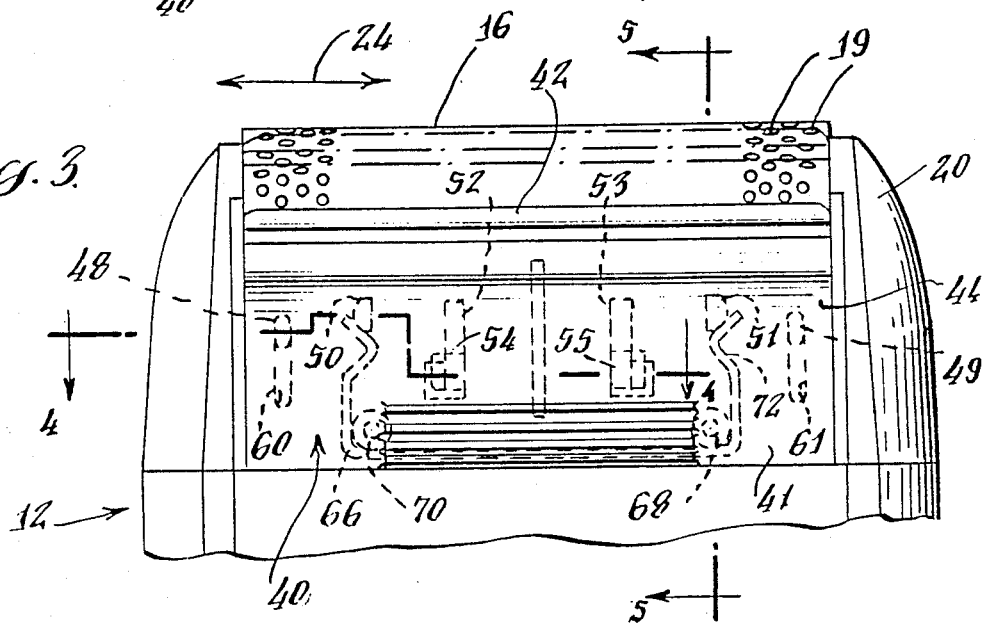
FIG. 3 is a fragmentary, enlarged, front elevation view of the electric dry shaver of FIG. 1.
Figure 4:
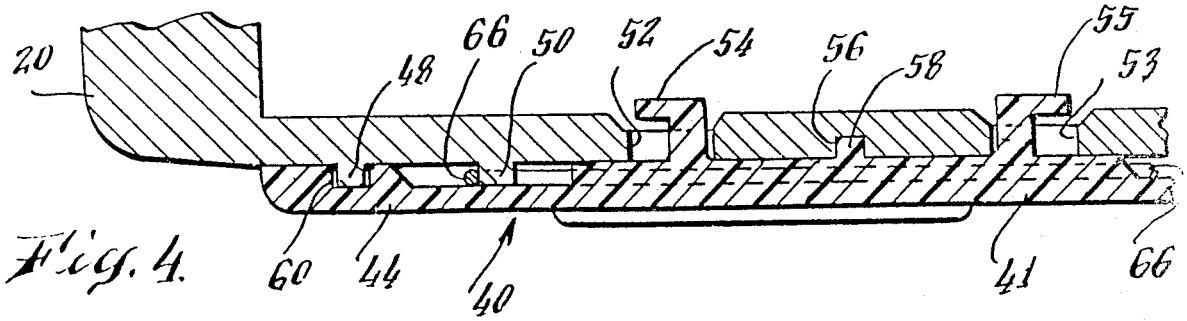
FIG. 4 is a view in section, taken along the line 4—4 of FIG. 3.

Refering now to the drawings, an electric dry shaver 10 is shown to include a hand-held housing 12 and a cutter head 14 which is mounted to the housing 12. The cutter head includes an elongated, longitudinally extending hair cutter assembly having a first, outer, stationary, foil type apertured cutter member 16 and a second inner, reciprocating cutter member 18 which is positioned in shearing engagement with the first member. The first, foil type, outer cutter member 16 includes a plurality of apertures 19 formed therein. It is positioned on and secured to a demountable hair pocket member 20. The second, inner, reciprocating cutter member 18 comprises an elongated assembly of cutter blades which are supported in spring biased engagement with said outer foil member 16. This cutter blade assembly is supported on an oscillator arm 22 and is reciprocated in a logitudinal direction 24 by the oscillator arm. The latter arm is mechanically coupled to an electrically energized motor which is positioned in the housing 12. The mechanical coupling means and electric motor drive are conventional and are not illustrated for purposes of simplifying the drawings. Upon manipulation of the housing 12 by the user, the outer foil cutter member 16 is advanced over a user's face or other body site, the user's body hair will extend through the foil apertures 19 and is sheared by relative motion between the reciprocating blade assembly and the foil. A hair trimmer 30 is also provided for trimming side burns and moustaches. The hair trimmer 30 extends longitudinally with the length of the cutter head assembly and is mechanically energized by an oscillator member 32 which is mechanically coupled to the electrical motor, not shown and previously referred to. The foregoing arrangement is conventional and is known in the art. An example of one such shaver is the model XLR which is marketed by the applicant.

Figure 5:
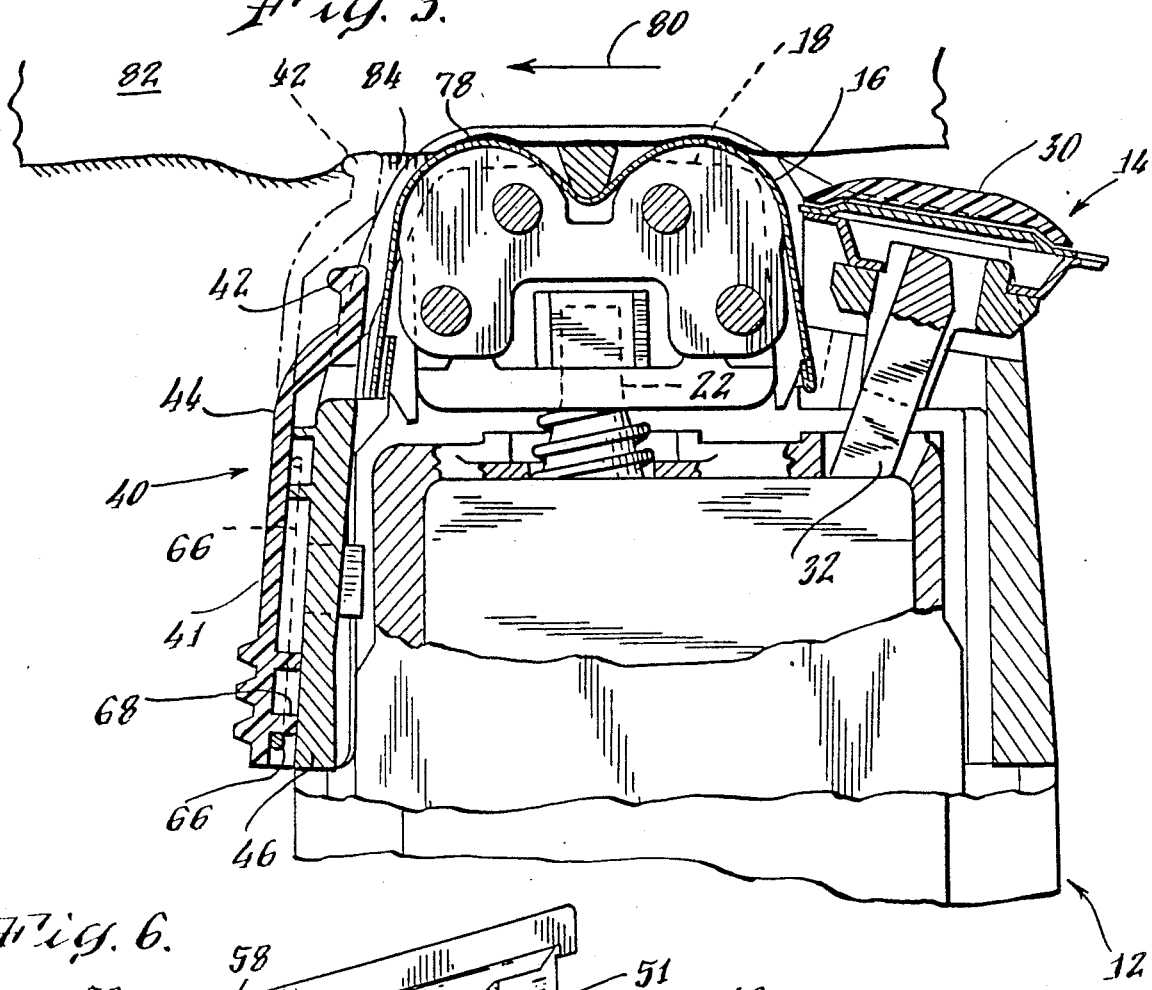
FIG. 5 is a fragmentary view, partly in section and partly broken away, taken along line 5—5 of FIG. 3 and illustrating a stretcher means in alternative extended and retracted positions, the stretcher means shown engaging a user's skin in the extended position.
Figure 6:
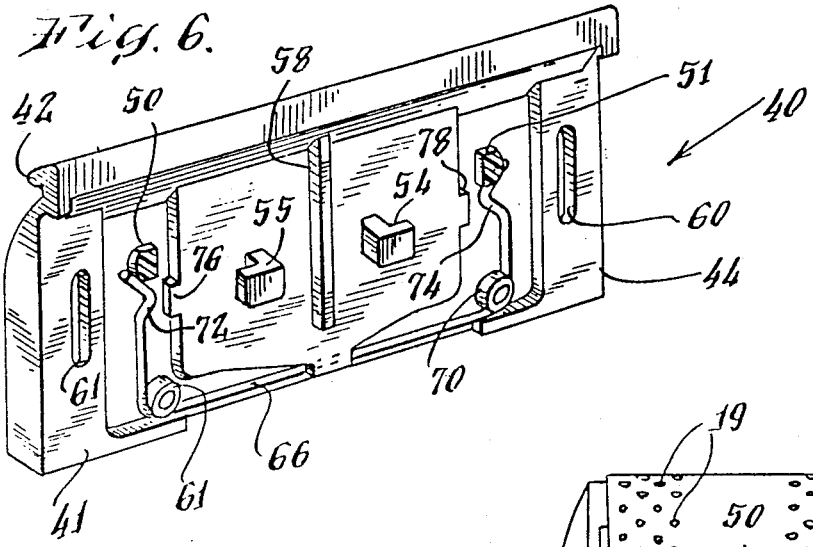
FIG. 6 is a perspective view of a slide body skin stretcher means of FIG. 5; and, FIG. 7 is a fragmentary, elevation view of a hair pocket of the electric dry shaver of FIG. 1 with slide body removed therefrom.
Figure 7:
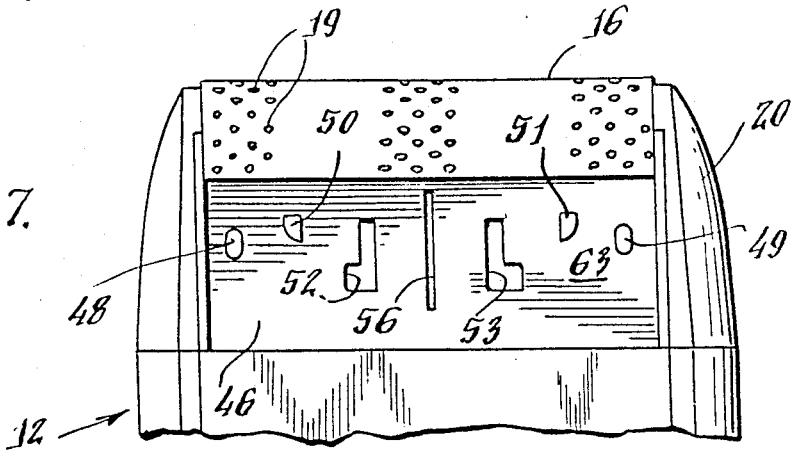

In accordance with this invention, the operation of an electric dry shaver is enhanced by the use of a skin stretcher means referenced generally as 40 in FIG. 5. The skin stretcher means 40 comprises a slide body 41 which extends longitudinally with and generally parallel to the cutter head assembly. It is spaced laterally from the cutter head assembly. As illustrated in the drawings, the skin stretcher slide body 41 includes an upper, distal skin contact segment 42 and an integrally molded, lower segment 44. Slide body 41 is mounted to the hair pocket 20 and is positioned adjacent to and in sliding engagement with a wall segment 46 of the hair pocket. The wall segment 46, as best seen in FIG. 7, includes extending stop bosses 48 and 49, extending detent bosses 50 and 51, apertures 52 and 53 for receiving neck-shaped guide segments 54 and 55 of the slide body 41 and a groove 56 for engaging a sliding guide 58 of the slide body 41. Stop bosses 48 and 49, detent bosses 50 and 51 and groove 56 are integrally molded with the hair pocket 20 which is formed of a polymer plastic. Slide body 41 is similarly formed of a polymer plastic and guides 54, 55 and 58 are formed integrally therewith. The guide body 41 further includes slots 60 and 61 formed therein for engaging the stop bosses 48 and 49 respectively. Guide body 41 is mounted in sliding engagement with a surface 63 of the hair pocket wall segment 46 by extending the neck segments 54 and 55 through the apertures 52 and 53 respectively. When so placed, the stop bosses 48 and 49 engage the slots 60 and 61 respectively and the sliding guide 58 engages the groove 56. The slide body 41 may then be raised and lowered in sliding engagement with the surface 63 of wall segement 46. It can alternatively be advanced to a first upper extended position, as shown in dashed lines in FIG. 5 and it can be withdrawn to a second lower retracted position as shown in section in FIG. 5. Slide body 41 is maintained in its alternate positions by a spring biasing means comprising a spring member 66 which is positioned adjacent to and extended about posts 68 and 70 of the slide body 41 which retain the spring member in fixed orientation. Curved segments 72 and 74 of the spring 66 engage the spring detenting bosses 50 and 51, respectively and function to provide a detent for the slide body 41 in the upper extended position and alternatively at the lower retracted position. Dead stops 74 and 76 which extend longitudinally are also integrally molded with the slide body 41 and limit lateral movement of the spring segments 72 and 74. This facilitates assembly of the slide body 41 to the hair pocket 20. Slide body 41 further includes a plurality of ridges 76 formed therein in order to provide a finger grip for permitting a user to manually advance or retract the body between the extended and retracted positions.

When advanced to the extended position, the skin contact segment 42 is raised to its highest level which is preferably slightly below or at substantially the same level as a crest 78 (FIG. 5) of the outer cutter member 16. In use, the shaver will be advanced in the general direction indicated by reference arrow 80 (FIG. 5). In FIG. 5, a user's skin, referenced generally by numeral 82, is shown contacted by the dashed line slide body segment 42. Segment 42 will contact the user's skin and cause skin tensioning as the shaver is advanced. This tensioning will occur in the skin area contacted by the trailing crest 78 of the foil cutter. Skin waves and undulations are thereby leveled by the tensioning and hairs 84 to be sheared are presented to the cutter in a relatively erect attitude for cutting. The cutting performance of the shaver is thereby substantially enhanced.

Slide body 41 is readily withdrawn to the retracted position by the application of finger force to the finger gripping ridges 76. In the withdrawn position, slide body segment 42 is positioned out of contact with the skin and the skin tension function becomes inoperative. In the retracted position, the cutter head can be placed at the usual difficult to reach body sites as for example, under the nose, etc. without interference by the skin stretcher.

An electric dry shaver has thus been described which includes an improved means for skin tensioning and enhances the cutting performance of the shaver. A skin tensioning means has been described which can be advanced to an operative position or withdrawn to a retracted position at which location the tensioning function is inhibited thereby enabling placement of the shaver at difficult to use body sites.

While there has been described a preferred embodiment of the invention, it will be appreciated by those skilled in the art that variations may be made thereto without departing from the spirit of the invention or the scope of the appended claims.

What is claimed is:

1. An improved, electric dry shaver, comprising:

(a) a hand held housing;

(b) a cutter head mounted to said housing;

(c) said cutter head including a demountable hair pocket having a side wall thereof, said side wall having an exterior surface thereof;

(d) said cutter head having an elongated, longitudinally extending hair cutter assembly including a first stationary, apertured cutter member, and, a second reciprocating cutter member positioned in shearing engagement with said first member;

(e) said cutter head assembly adapted to shear body hair which extends through said first cutter member apertures when said cutter head is positioned by a user for engaging body hair;

(f) an electrically energized actuating means mounted in said housing and mechanically coupled to said reciprocating cutter member for imparting reciprocating motion to said second cutter member upon electrical energization of said actuating means;

(g) an elongated, longitudinally extending skin stretcher means laterally spaced from and extending generally parallel with hair cutter assembly;

(h) said skin stretcher means including a slide body mounted to said hair pocket side wall in sliding engagement with said exterior surface; and, (i) means for selectively positioning said skin stretcher slide body at a first extended position in engagement with said exterior wall surface at which said slide body engages a user's skin and causes tensioning of the skin over an area which includes the location at which said cutter head assembly engages body hair, and, for positioning said skin stretcher slide body at a second retracted position in engagement with said exterior wall surface at which position said slide body is positioned substantially out of engagement with the user's skin and does not cause tensioning thereof in the area at which said cutter head assembly engages the user's body.

2. The shaver of claim 1 including guide means for guiding movement of said slide body in sliding engagement with said wall surface.

3. The shaver of claim 2 including means for biasing said slide body at two different positions.

4. The shaver of claim 3 wherein said biasing means includes a resilient body.

5. The shaver of claim 2 wherein said slide body includes first and second extending guides and said hair pocket includes first and second extending grooves for receiving and engaging said guides.

6. The shaver of claim 5 including first and second grooves formed on said slide body and first and second slide stops formed on said hair pocket and positioned in engagement with said slide body grooves.

* * * * *